US005599211A

United States Patent [19]

Kurahashi et al.

[11] Patent Number: 5,599,211

[45] Date of Patent: Feb. 4, 1997

[54] TERMINAL DEVICE

[75] Inventors: Yoshio Kurahashi, Fujisawa; Susumu Henmi, Yamato, both of Japan

[73] Assignee: Emuden Musen Kogyo Kabushiki Kaisha, Kanagawa, Japan

[21] Appl. No.: 525,379

[22] Filed: Sep. 8, 1995

[30] Foreign Application Priority Data

Sep. 8, 1994 [JP] Japan ..... 6-214862
Aug. 7, 1995 [JP] Japan ..... 7-201178

[51] Int. Cl.[6] ..... H01R 4/40

[52] U.S. Cl. ..... 439/806; 439/812

[58] Field of Search ..... 439/806, 810, 439/811, 812, 814

[56] References Cited

U.S. PATENT DOCUMENTS 3,812,453 5/1974 Kiessling ..... 439/806
4,090,762 5/1978 Hoffman ..... 439/806
4,175,822 11/1979 Debaigt ..... 439/806
4,601,451 7/1986 Leonardo ..... 439/806
4,695,920 9/1987 Klebba et al. ..... 439/806

*Primary Examiner*—P. Austin Bradley
*Assistant Examiner*—T. C. Patel
*Attorney, Agent, or Firm*—Morrison Law Firm

[57] ABSTRACT

A fixed terminal hingably supports a movable terminal of a terminal device. A terminal screw passes through a hole in the fixed terminal to engage a threaded hole in the movable terminal. A captivating device prevents the terminal screw from being withdrawn from the fixed terminal. The terminal screw, when tightened, clamps an element to be connected between the fixed and movable terminals. The captivating device, when the terminal screw is loosened, urges the movable terminal away from the fixed terminal to separate the two, thereby positively releasing the element connected therebetween.

2 Claims, 7 Drawing Sheets

TERMINAL DEVICE

BACKGROUND OF THE INVENTION

The present invention relates to a terminal device and, more particularly to a terminal device mounted on a terminal board for connecting wires for uses such as the output of electric power or signal. The present invention also relates to a crimp-style terminal for connected wires, ribbons or cables.

A terminal is any point on an element, component, device, etc. to which an element is attached. Conventional terminal devices typically have a terminal screw threaded into a fixed terminal strip. Conventionally, a wire is crimped between the head of the terminal screw and a surface of the fixed terminal strip.

Typically, the end of the wire is bent into a hooked shape that is positioned around the threaded shaft of the terminal screw. The terminal screw is then tightened to sandwich the wire between the screw head and the terminal strip surface. The connection is often unreliable because the wire can move, while the terminal screw is being tightened, so that the wire is not fully secured by the screw and surface.

Another source of unreliability is the poor crimping force exerted by conventional devices from their sandwiching a wire between the surface of the fixed terminal strip and the head of the terminal screw.

Another problem with conventional terminals is that the user, in trying to secure the wire, may overtighten the screw. Such overtightening can lead to the screw thread being stripped or to the wire being broken.

Another way users try to assure a good connection with conventional terminals is to form a full loop around the screw with the wire. Although this helps with the positioning of the wire, it makes disconnection of the wire difficult, particularly if the wire is of a heavy gauge.

Attempts to overcome the problems with the conventional screw and terminal surface connection include adding plain washers or star washers between the wire and the screw head or the terminal surface. These attempts do not fully overcome the problems of unreliability and difficulties in connecting and disconnecting.

Other attempts include using ratchet-like trap mechanisms in devices that, although they are easy to connect, are very difficult to disconnect. Often such mechanisms require cutting the wire to disconnect. Thus they can lead to disadvantageous shortening of the wire length.

OBJECTS AND SUMMARY OF THE INVENTION

It is an object of the invention to provide a terminal device which overcomes the drawbacks of the prior art.

It is a further object of the present invention to provide a terminal device that is easy to assemble while ensuring reliable connection of wires, cables or ribbons.

It is an object of the present invention to provide a terminal device that is easy to assemble while ensuring reliable electrical connection of electric wires or ribbons.

It is an object of the present invention to provide a terminal device that is easy to assemble while ensuring secure connection of wires or ribbons that are made of metals such as copper, iron, steel, or aluminum.

It is an object of the present invention to provide a terminal device that is easy to assemble while ensuring secure connection of wires or ribbons that are made of non-metals such as carbon fiber, glass fiber, polymeric resin fiber, or some combination of materials such as composite ribbons.

It is an object of the present invention to provide a terminal device that is easy to assemble while ensuring secure connection of wires or ribbons that are single or multi-stranded.

It is a further object of the present invention to provide a terminal device having an insulating body frame with a fixed terminal strip on it. The fixed terminal strip has a terminal screw insertion hole. A movable terminal strip swings to catch the fixed terminal strip.

The movable terminal strip has a connecting portion and a threaded terminal screw fastening hole. The connecting portion is formed at the front end of the movable terminal strip to press against the fixed terminal strip. The terminal screw fastening hole is correspondingly positioned with the terminal screw insertion hole.

A terminal screw is inserted through the terminal screw insertion hole of the fixed terminal strip and screwed into the threaded terminal screw fastening hole of the movable terminal strip. Tightening the terminal screw causes the movable terminal strip to press against the fixed terminal strip. Therefore, a wire inserted between the movable terminal strip and the fixed terminal strip is securely connected by forceful clamping between the strips as the terminal screw is tightened.

It is another object of the invention to provide a terminal device having a fixed terminal strip and a movable terminal strip that rotates around an engaging point. The movable terminal strip has a terminal screw threaded through it so that the connecting portion of the movable terminal strip comes either into or out of contact with the fixed terminal strip depending on the direction that the terminal screw is turned.

By inserting a wire or ribbon between the connecting portion of the movable terminal strip and the fixed terminal strip, while they are apart, and tightening the terminal screw, the connecting portion of the movable terminal strip swings around the engaging point toward the fixed terminal strip to clamp the wire between the connecting portions.

Where the wire or ribbon is an electric conductor, an electrical connection is made. The clamping of the wire between the fixed terminal strip and the connecting portion of the movable terminal strip causes a crimping that ensures a robust and secure electrical connection. Turning the terminal screw in the reverse direction loosens the screw, thus swinging the connecting portion of the movable terminal strip around the engaging point. As a result, the connecting portion of the movable terminal strip disengages from the fixed terminal strip, thereby releasing the wire or ribbon from crimping.

It is a still further object of the invention to provide a terminal device having a movable terminal strip and a fixed terminal strip. The fixed terminal strip has a terminal screw insertion hole and the movable terminal strip has a threaded terminal screw fastening hole.

The movable terminal strip has a connecting portion and a catching portion. The connecting portion is formed by a nearly right angle bend in the front part of the movable terminal strip towards the fixed terminal strip. The catching portion is formed by a bend in the base end of the movable terminal strip in the same direction as that of the connecting portion.

The catching portion of the movable terminal strip has a catching hole through which is inserted the fixed terminal strip so that the movable terminal strip is connected with the fixed terminal strip while remaining capable of swinging. A threaded terminal screw fastening hole is positioned approximately halfway between the connecting portion and the catching portion.

In this configuration, a terminal screw is inserted through the terminal screw insertion hole of the fixed terminal strip and screwed into the threaded terminal screw fastening hole of the movable terminal strip. Thus, the fixed terminal strip is caught in the catching hole of the catching portion of the movable terminal strip. Tightening the terminal screw causes the connecting portion of the movable terminal strip to press against the fixed terminal strip.

It is yet still another object of the invention to provide a terminal device having a body frame with one or more terminal housing compartments. Each compartment has a rear opening, a top operation opening, and a front wire insertion hole that allows a wire to be inserted between a fixed terminal strip and the connecting portion of a movable terminal strip. Each inner side surface of the compartments has a catching groove, open at the rear, to catch a corresponding edge of the fixed terminal strip.

In this configuration, the head of each terminal screw is positioned facing the inner end of the operation hole of the body frame so that the screw can be turned by a tool operated trough the operation hole. The wire insertion hole of the body frame is positioned to permit inserting a wire between the fixed terminal strip and the connecting portion of the movable terminal strip.

It is another object of the invention to provide a terminal device having a body frame with one or more terminal housing compartments that is easily assembled. The three components parts: fixed terminal strips, movable terminal strips and terminal screws are assembled into the body frame by engaging the fixed terminal strips of each unit in the catching grooves, positioning the movable terminal strips in aligmnent, and threading the terminal screws into place.

It is still another object of the invention to provide an easily assembled terminal device having a movable terminal strip and a fixed terminal strip. The fixed terminal strip has a terminal screw insertion hole and the movable terminal strip has a threaded terminal screw fastening hole.

The movable terminal strip has a connecting portion and a catching portion. A threaded terminal screw fastening hole is formed approximately halfway between the connecting portion and the catching portion.

The connecting portion is formed by a nearly right angle bend in the front part of the movable terminal strip towards the fixed terminal strip. The catching portion is formed by a bend in the base end of the movable terminal strip in the same direction as that of the connecting portion.

The catching portion of the movable terminal strip has a catching hole through which is inserted the fixed terminal strip so that the movable terminal strip is connected with the fixed terminal strip while still capable of swinging.

The catching hole has at its middle a slot opening, narrower than the width of the catching hole itself, to the end of the catching portion. The base end of the fixed terminal strip has a narrow tang that has two portions. The end portion of the tang is narrower than the width of the slot opening of the catching hole. The wider tang portion further from the end, next to the narrower portion, is narrow enough to fit into the catching hole but wider than the slot opening.

In this configuration, the terminal device is easily assembled by inserting the narrower portion of the tang through the slot opening, sliding the tang in the catching hole until the wider tang portion is engaged in the catching hole of the catching portion of the movable strip. The movable and fixed terminal strips can now pivot about the catching hole.

A terminal screw is inserted through the terminal screw insertion hole of the fixed terminal strip and screwed into the threaded terminal screw fastening hole of the movable terminal strip. Thus, tightening the terminal screw causes the connecting portion of the movable terminal strip to press against the fixed terminal strip.

Briefly stated, the present invention provides a fixed terminal which hingably supports a movable terminal of a terminal device. A terminal screw passes through a hole in the fixed terminal to engage a threaded hole in the movable terminal. A captivating device prevents the terminal screw from being withdrawn from the fixed terminal. The terminal screw, when tightened, clamps an element to be connected between the fixed and movable terminals. The captivating device, when the terminal screw is loosened, urges the movable terminal away from the fixed terminal to separate the two, thereby positively releasing the element connected therebetween.

According to an embodiment of the invention, there is provided a terminal device comprising: a fixed terminal strip, a terminal screw insertion hole in the fixed terminal strip, a movable terminal strip, means for hinging the movable terminal strip with respect to the fixed terminal strip, a threaded hole in the movable terminal strip, a terminal screw passing through the terminal screw insertion hole and threadingly engaging the threaded hole, a raised portion overlapping the terminal screw, means in the raised portion for permitting adjustment access therethrough to the terminal screw, the means in the raised portion having a dimension effective for captivating the terminal screw, whereby the terminal screw, when loosened, is urged against an interior of the raised portion, and the terminal screw urges the movable terminal strip away from the fixed terminal strip, means for permitting entering of an element to be clamped between the fixed terminal strip and the movable terminal strip when the movable terminal strip is in the loosened condition, and means on at least one of the fixed terminal strip and the movable terminal strip for clamping the element therebetween when the movable terminal strip is tightened.

The above and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 7:
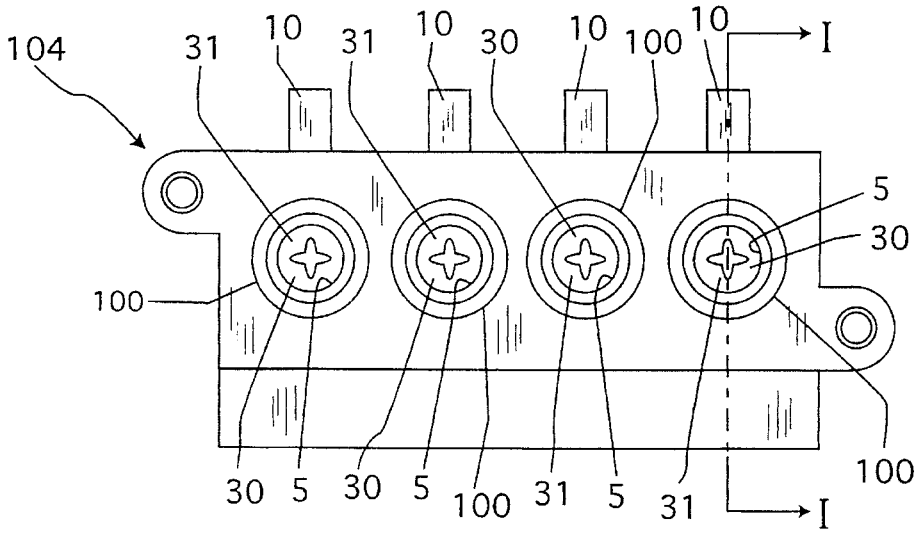
FIG. 7 is a top view of terminal board according to an embodiment of the present invention with terminal devices mounted on it.
Figure 8:
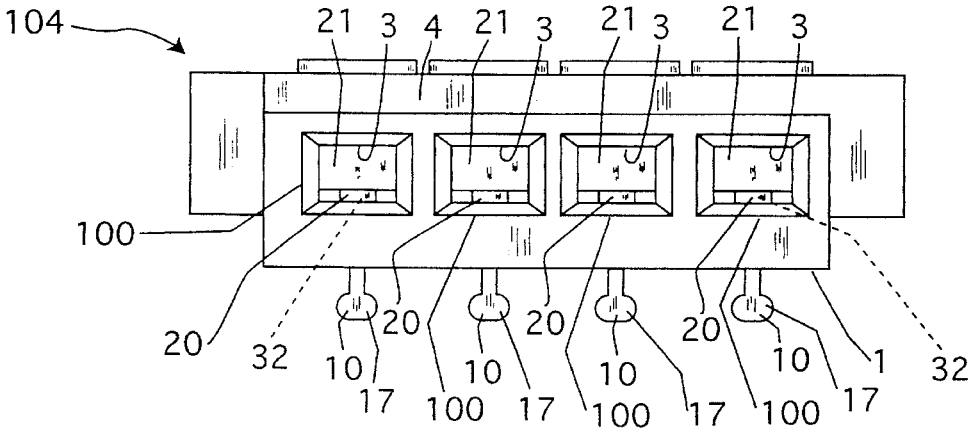
FIG. 8 is a front view of terminal board according to an embodiment of the present invention with terminal devices mounted on it.

Referring to FIGS. 7 and 8, a terminal board 104 includes a plurality of mounted terminal devices 100. An insulating body frame 1 of terminal board 104 is formed of material such as, preferably, an insulating material such as a synthetic resin. Insulating body frame 1 is partitioned in parallel to form a plurality of terminal housing compartments 2.

Figure 6:
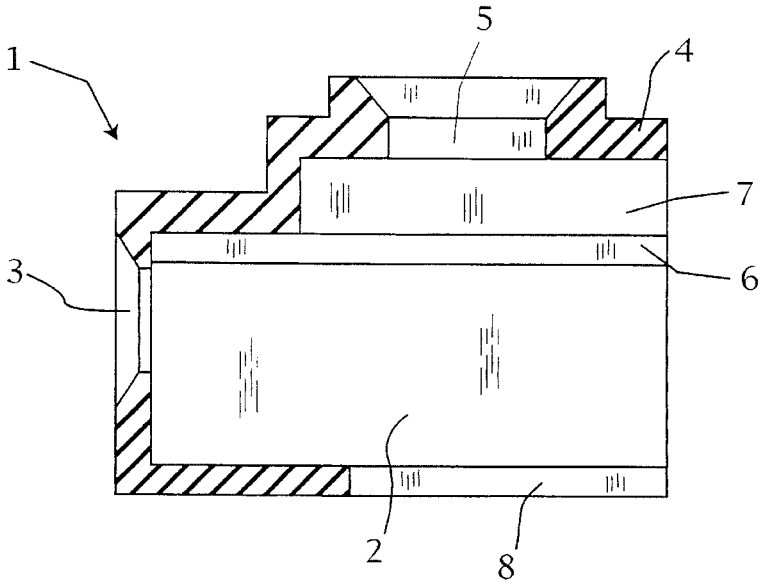
FIG. 6 is a cross-section of a body frame according to an embodiment of the present invention.

Referring now also to FIG. 6, a wire insertion hole 3 through a front of each terminal housing compartment 2 permits insertion of wires, cables or ribbons therethrough. A rear of each terminal housing compartment 2 is open.

Figure 1:
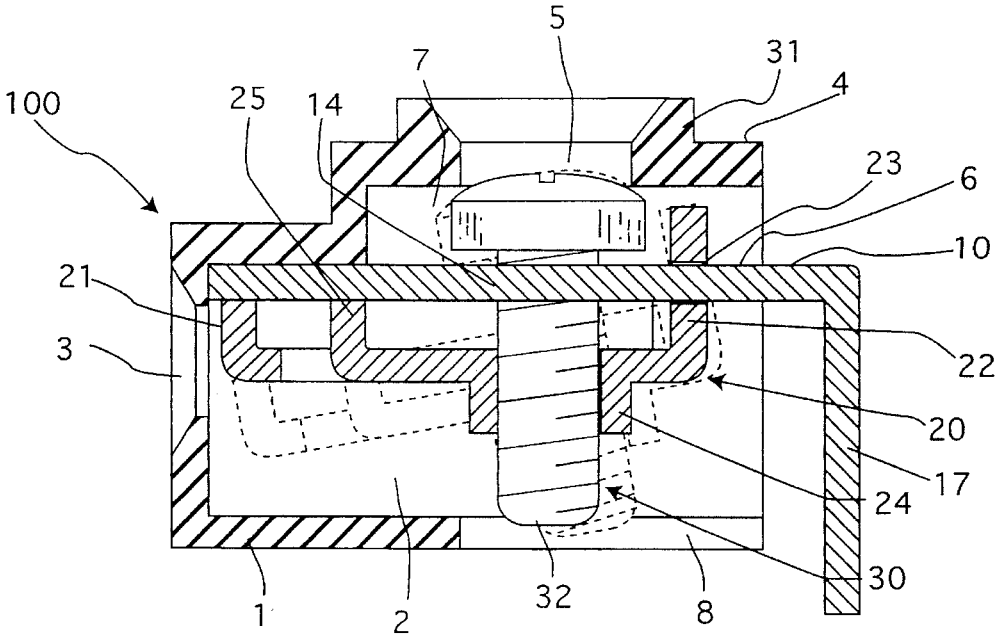
FIG. 1 is a sectional view of a terminal device taken through section I—I of FIG. 7 according to an embodiment of the present invention.

Referring now also to FIG. 1, a raised portion 4 on a top of body frame 1 at an upper part of each terminal housing compartment 2 defines a space 7. Each space 7 houses a head 31 of a terminal screw 30. Head 31 has a diameter larger than a threaded shaft 32 of terminal screw 30.

Each terminal housing compartment 2 has an operation aperture 5 at the top of raised portion 4. Each operation aperture 5 opens through space 7 to an interior of terminal housing compartment 2. A catching groove 6 in each inner side wall of each terminal housing compartment 2 extends along a top of a front part of terminal housing compartment 2 and open at the rear. A cutout 8, at the bottom of each terminal housing compartment 2, extends from a point facing operation aperture 5 and continues fully to the rear.

Figure 4:
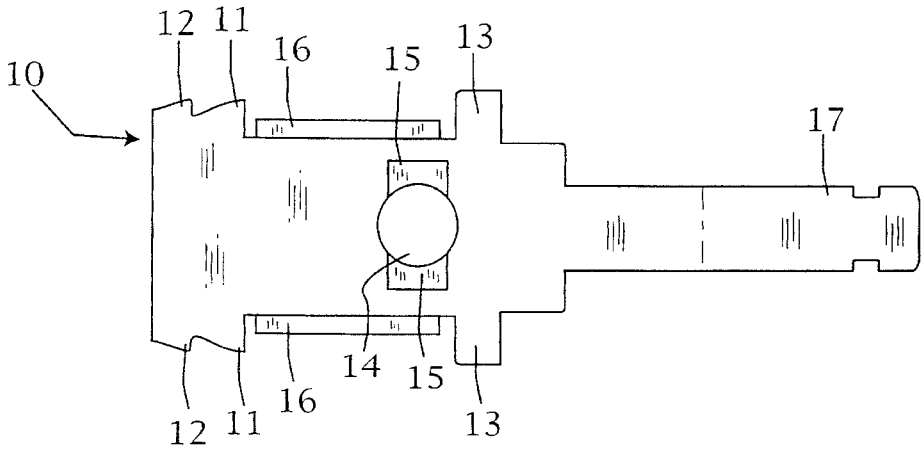
FIG. 4 is a top view of a fixed terminal strip according to an embodiment of the present invention.
Figure 5:
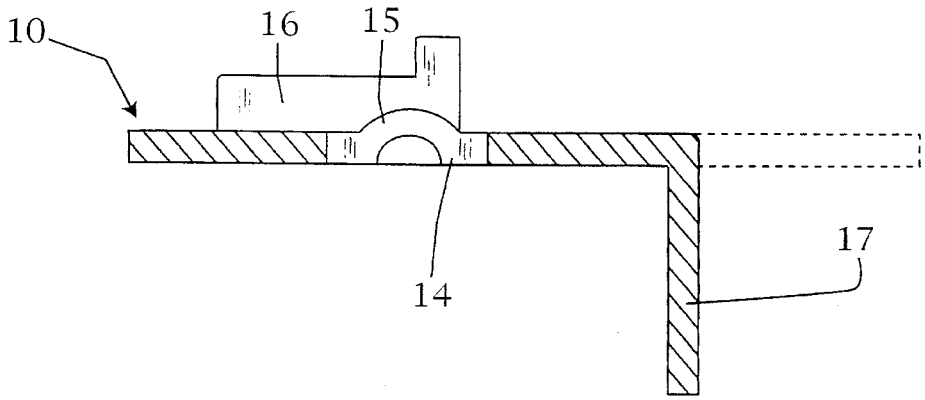
FIG. 5 is a cross-section of a fixed terminal strip according to another embodiment of the present invention.

Referring to FIGS. 1, 4 and 5, in a second embodiment of the invention, a terminal device 100 includes a fixed terminal strip 10 formed by any convenient means such as, for example, by punching from a metal plate. Fixed terminal strip 10 has a wire connecting portion 17 that may be bent at an angle as generally shown in FIG. 5 as 10'.

Front stopper portions 11 for catching respective catching grooves 6 of insulating body frame 1 protrude from both sides of the front part of fixed terminal strip 10. The lateral edge of each front stopper portion 11 is cut out to form a stopper hook 12, which prevents the front stopper portion 11 from slipping off.

A rear stopper portion 13 is formed at each lateral edge of fixed terminal strip 10, at a distance from front stopper portion 11. Fixed terminal strip 10 also has terminal screw insertion hole 14 approximately at the middle of fixed terminal strip 10 between front stopper portions 11 and rear stopper portions 13.

Both lateral sides of terminal screw insertion hole 14 include curved portions 15 which bulge upward. Reinforcement edges 16 are formed at both lateral sides of fixed terminal strip 10 by bending upward the portion of each edge between front stopper portion 11 and rear stopper portion 13. The rear part of fixed terminal strip 10 is bent downward to form wire connecting portion 17.

Figure 2:
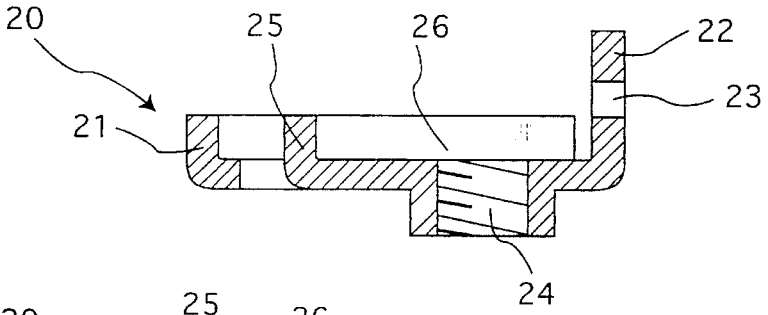
FIG. 2 is a sectional view of a terminal strip taken through section II—II of FIG. 3 according to an embodiment of the present invention.
Figure 3:
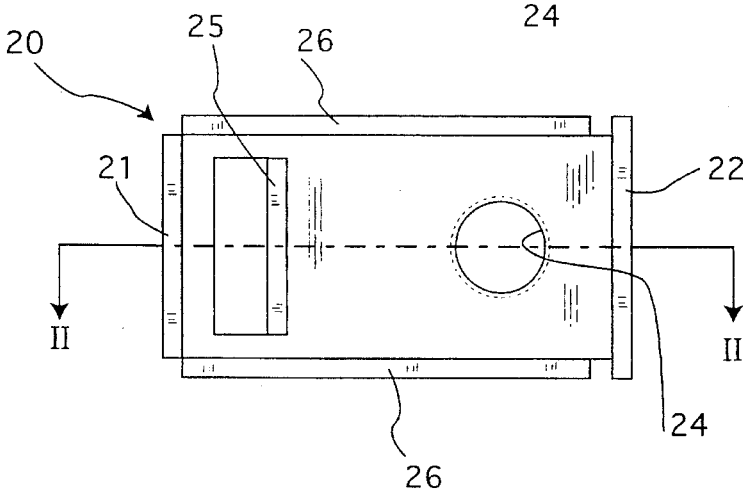
FIG. 3 is a top view of a movable terminal strip, according to an embodiment of the present invention.

Referring to FIGS. 1, 2 and 3, a third embodiment includes a terminal device 100 includes a movable terminal strip 20. A front end and a base end of movable terminal strip 20 are bent nearly vertically upward, forming respectively connecting portions 21 and 22. Connecting portion 22 has catching hole 23 for inserting through fixed terminal strip 10. Movable terminal strip 20 may be formed by any convenient means such as, for example, by punching from a metal plate.

Movable terminal strip 20 has a threaded terminal screw fastening hole 24 at its approximate midpoint. Movable terminal strip 20 also has an auxiliary connecting portion 25 extending parallel to connecting portion 21. Auxiliary connecting portion 25 is formed by cutting and bending a portion of movable terminal strip 20.

A reinforcing edge 26 projects upward from each lateral edge of movable terminal strip 20 to prevent deformation of movable terminal strip 20. Threaded shank 32 of terminal screw 30 passes through terminal screw insertion hole 14 of fixed terminal strip 10 and into threaded engagement with terminal screw fastening hole 24. Head 31, which is the widest in diameter part of terminal screw 30, is housed in space 7 defined by raised portion 4 at the upper part of terminal housing compartment 2 of body frame 1. An operation aperture 5 in raised portion 4 permits access to head 31, and thereby permits rotation of terminal screw 30. Operation aperture 5 is smaller than head 31, whereby head 31, and the remainder of terminal screw 30 remain captivated.

Fixed terminal strip 10 is fitted in catching hole 23 of movable terminal strip 20. This allows movable terminal strip 20 to swing by pivoting at catching hole 23.

Threaded shank 32 of terminal screw 30 is tightened or loosened in terminal screw fastening hole 24.

The assembly consisting of fixed terminal strip 10, movable terminal strip 20 and terminal screw 30 installed into body frame 1. Front and rear stopper portions 11 and 13 at both sides of fixed terminal strip 10 are inserted into catching grooves 6 of body frame 1 from the open rear end of each groove 6 until stopper portions 11 and 13 are securely stopped. At this point, movable terminal strip 20 and threaded shank 32 of terminal screw 30 are positioned in terminal housing compartment 2 while head 31 of terminal screw 30 is captivated in space 7.

Fixed terminal strip 10 is supported by stopper hooks 12 of front stopper portions 11 and is thus prevented from accidentally slipping off catching grooves 6. In this state, head 31 of terminal screw 30 is located inside operation hole 5. Connecting portions 21 of movable terminal strip 20 are held in terminal housing compartment 2 generally aligned with wire insertion hole 3.

In operation, a screwdriver is inserted through operation hole 5 of body frame 1 to loosen terminal screw 30 so that movable terminal strip 20 swings counterclockwise around the engaging point where fixed terminal strip 10 engages catching hole 23. Downward force is generated by the engagement of head 31 with the interior of raised portion 4 adjacent operation aperture 5. Threaded shank 32 remains screwed into terminal screw fastening hole 24. The rotation of movable terminal strip 20 away from the interior surface of fixed terminal strip 10 is constrained by an interior surface of terminal housing compartment 2 from rotating so far as to allow terminal screw 30 from disengaging from terminal screw fastening hole 24.

Thus, connecting portion 21 and auxiliary connecting portion 25 move away from the underside of fixed terminal strip 10 into an opened position shown by double-dashed lines in FIG. 1. In this position, a wire, or other element may be inserted through wire insertion hole 3 to a position between movable terminal strip 20 and an inner surface of fixed terminal strip 10.

Terminal screw 30 is tightened to swing movable terminal strip 20 clockwise to move connecting portion 21 into secure contact with the element to be clamped against fixed terminal strip 10 as shown by solid line in FIG. 1. The clamped element, such as an electric wire, is snugly sandwiched between fixed terminal strip 10 and connecting portion 21 and auxiliary connecting portion 25 of movable terminal strip 20. The electric wire is thus securely connected to the terminal.

Turning terminal screw 30 in the reverse loosening direction disconnects the clamped electric wire by rotating movable terminal strip 20 towards the position shown by chain double dashed line in FIG. 1, thus separating connecting portion 21 and auxiliary connecting portion 25 away from fixed terminal strip 10. The loosening operation is performed positively by the downward force generated by contact between head 31 and the interior surface of raised portion 4 adjacent the perimeter of operation aperture 5. The electric wire is released from the clamping pressure of the sandwich connection to permit removal through wire insertion hole 3.

Although the previous explanation of the invention's operation referred to the above embodiment includes a plurality of terminal devices mounted on a terminal board, it is apparent that the explanation applies equally well to a terminal board including only a single terminal device. In addition, an embodiment of the invention which omits the terminal board should also be considered to fall within the spirit and scope of the invention.

The present invention is applicable not only to a terminal board but also as a terminal device used for other electric appliances. Furthermore, the elements to be connected to a terminal device according to the invention is not limited to electric wire. It is apparent that other types of wire and terminator of a clamp-style terminal may also be connected.

Figure 9:
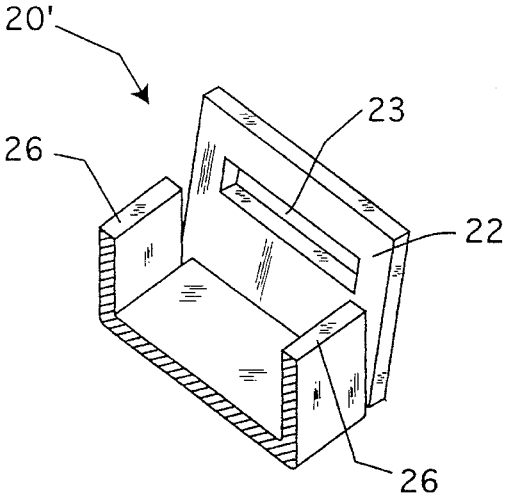
FIG. 9 is an oblique view of a part of a movable terminal strip according to an embodiment of the present invention.

Referring to FIGS. 1 and 9, a fourth embodiment is shown. A terminal device 100 includes a movable terminal strip 20' that has a catching portion 22, formed by bending upward the base end of movable terminal strip 20'. In contrast to the prior embodiments, catching portion 22, instead of being bent to an angle of approximately 90 degrees to movable terminal strip 20, is left slightly inclined outward. In all other physical and operational respects, movable terminal strip 20' is identical to movable terminal strips 20 of prior embodiments.

Tilting catching portion 22 outward, at an obtuse angle, produces a lateral shift in position of movable terminal strip 20', as well as an increase in respective distances from connecting portion 21 and auxiliary connecting portion 25 to the underside of fixed terminal strip 10, when movable terminal strip 20' swings around its engaging point. The engaging point is where fixed terminal strip 10 is caught in catching hole 23.

Movable terminal strip 20' is pivoted or swung by turning terminal screw 30 in terminal screw fastening hole 24. Therefore, with a terminal device with a catching portion 22 inclined as above, an electric wire is more easily inserted.

Figure 10:
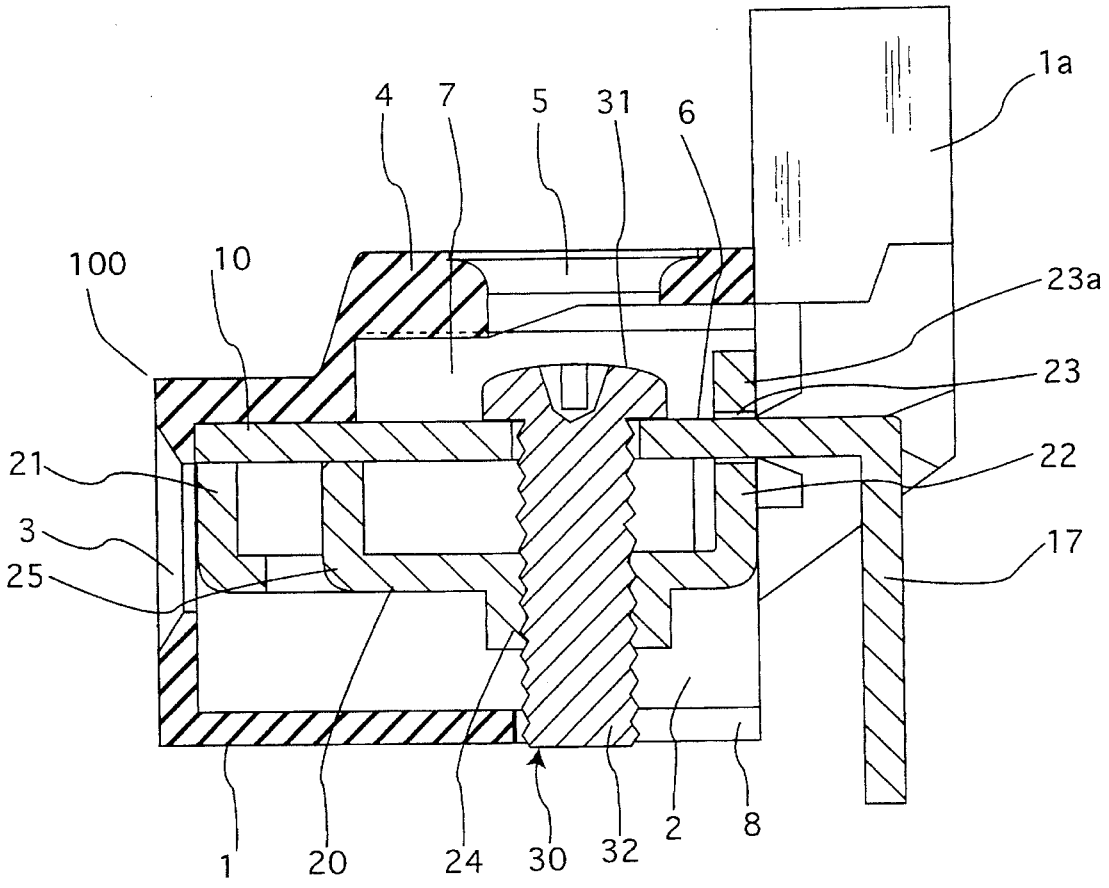
FIG. 10 is a sectional view of a terminal board taken through X—X of FIG. 12 according an embodiment of the present invention.
Figure 11:
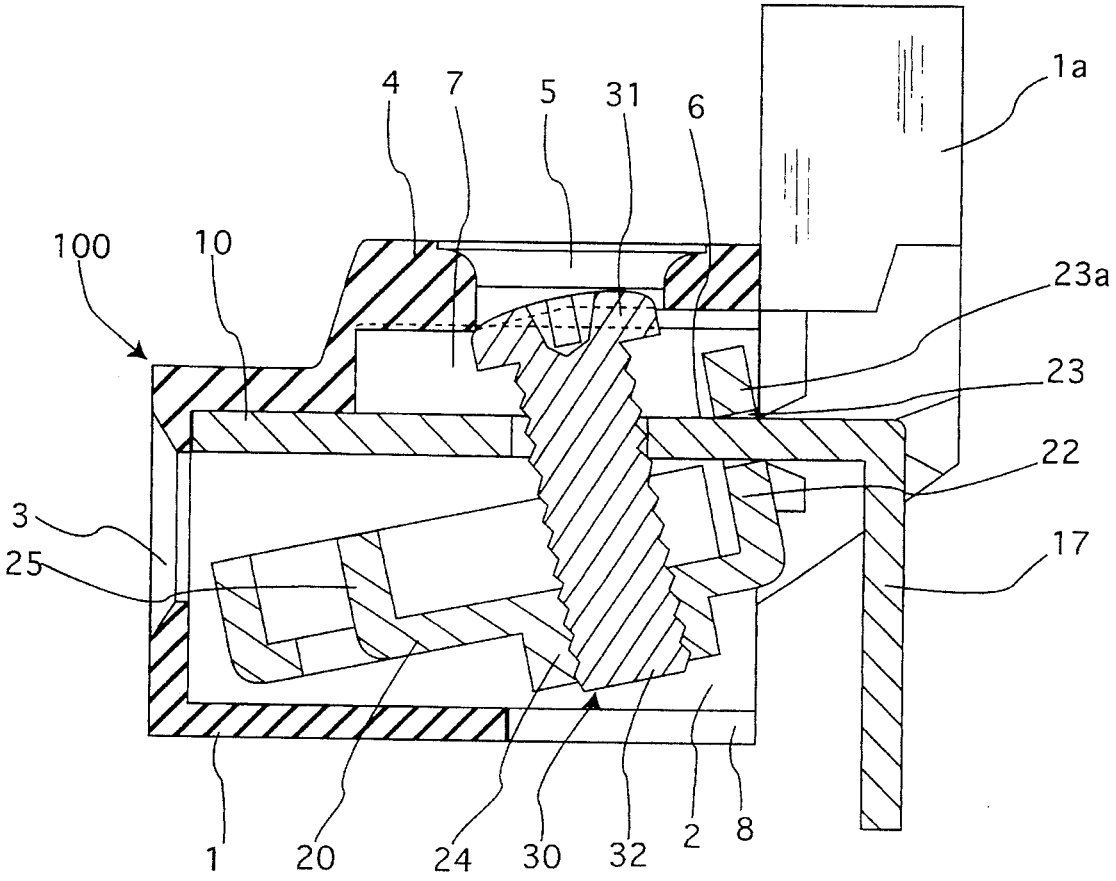
FIG. 11 is a sectional view of a terminal board taken through X—X of FIG. 12 according an embodiment of the present invention.
Figure 12:
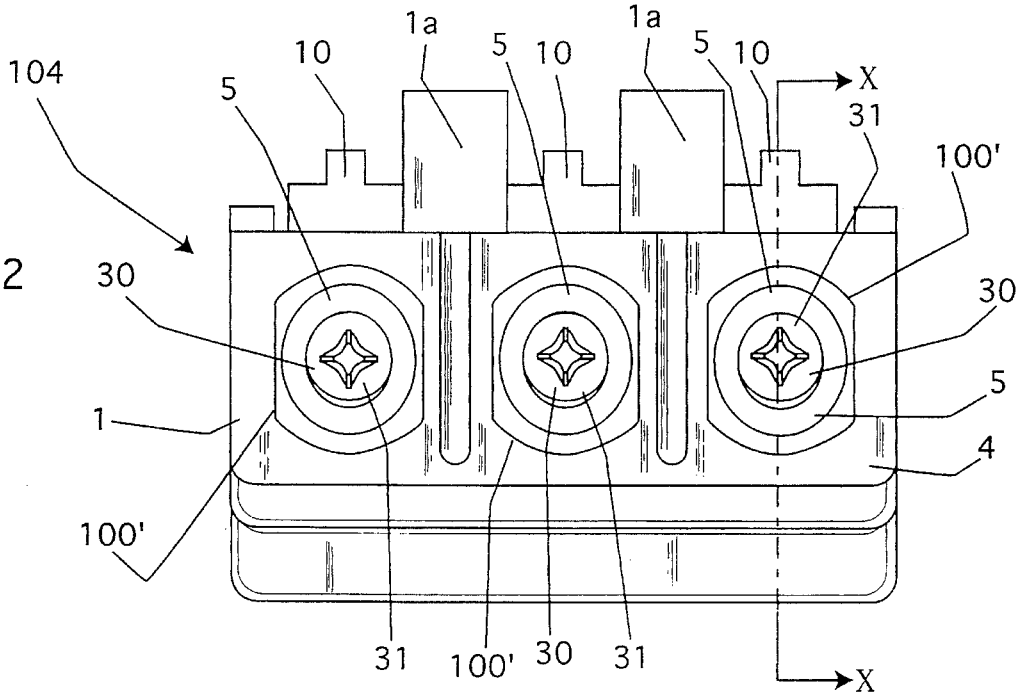
FIG. 12 is a top view of a terminal board according to an embodiment of the present invention.
Figure 13:
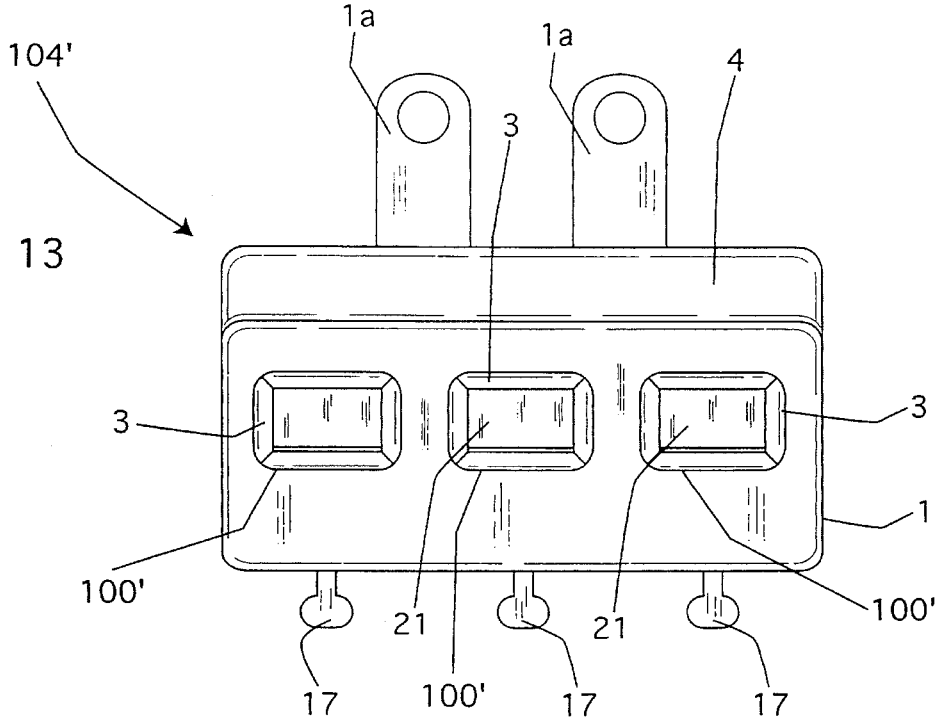
FIG. 13 is a front view of a terminal board according to an embodiment of the present invention.

Referring to FIGS. 12 and 13, a terminal board 104' includes a plurality of mounted terminal devices 100'. Referring further to FIG. 10, terminal device 100' includes a fixed terminal strip 10 formed by any convenient means such as, for example, by punching from a metal plate. The rear part of fixed terminal strip 10 is bent downward to form wire connecting portion 17. A terminal board attachment **1*a* is provided for mounting, attachment or connection of terminal device 100' or terminal board 104'** when mounted therein.

In all other physical and operational respects, terminal board 104' and terminal device 100' is identical to terminal board 104 and terminal device 100 of prior embodiments.

Figure 14:
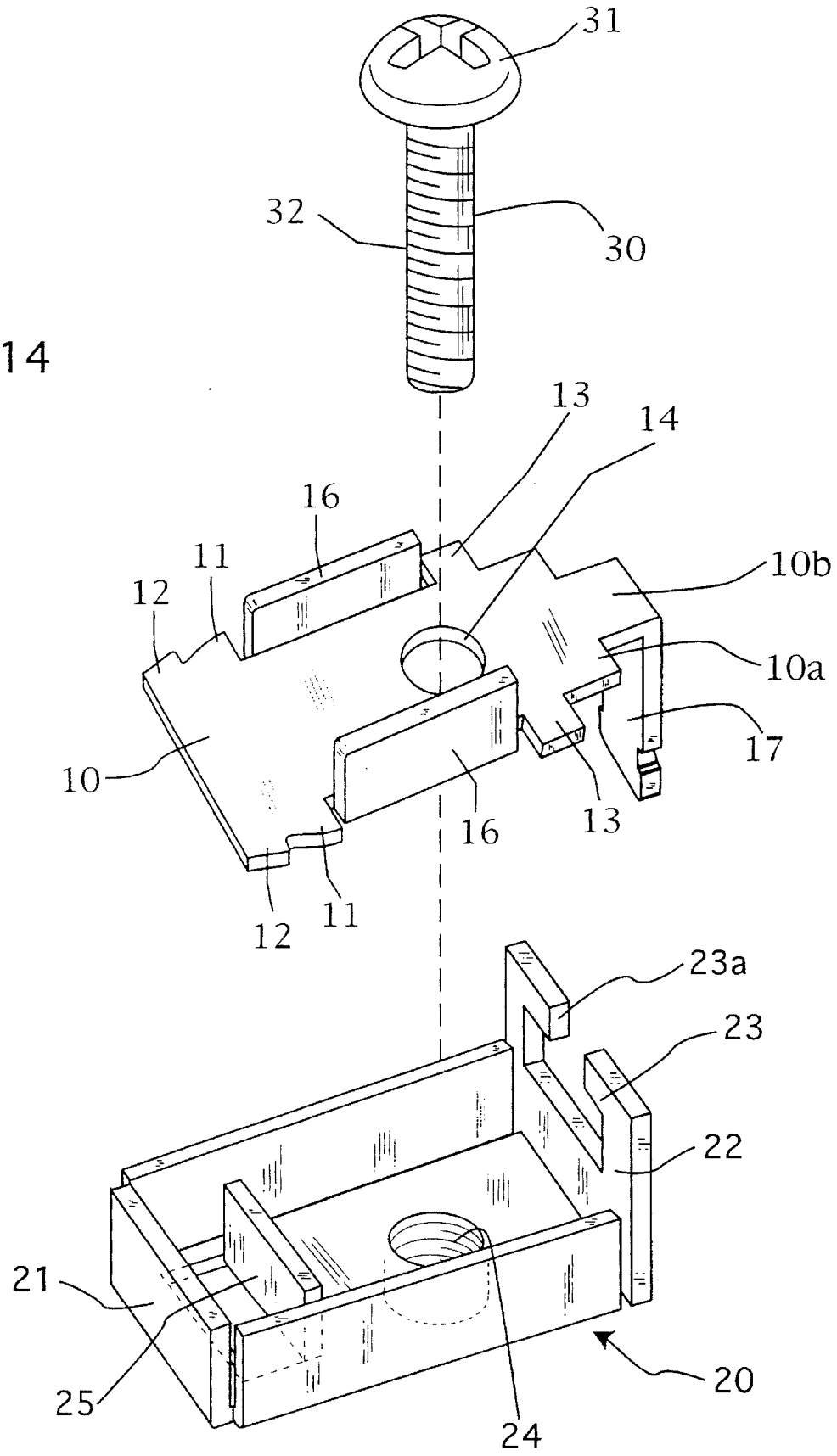
FIG. 14 is an exploded oblique view of a fixed terminal strip, a movable terminal strip and a terminal screw of a terminal device according to an embodiment of the present invention.

Referring to FIG. 14, movable terminal strip 20, fixed terminal strip 10 and terminal screw 30 of another embodiment are shown. The front end and the base end of movable terminal trip 20 are bent at nearly a right angle, forming connecting portions 21 and 22 respectively. Connecting portion 22 is provided with a catching hole 23 for inserting fixed terminal strip 10 through.

Catching hole 23 is not a completely enclosed hole but has a slot open to the edge of catching portion 22, thereby defining open portion **23*a*. Open portion 23*a* is narrower than catching hole 23**.

Fixed terminal strip 10 has, at its base end, catching portion **10*a* with a narrow portion 10*b*. Catching portion 10*a* is sized to fit through catching hole 23 but wider than open portion 23*a*, while narrow portion 10*b* is sized to fit through open portion 23*a***.

Movable terminal strip 20 is also provided with terminal screw fastening hole 24 approximately at its middle. Movable terminal strip 20 also has an auxiliary connecting portion 25 which extends parallel to connecting portion 21 and is formed by cutting and bending a portion of movable terminal strip 20.

Reinforcing edge 26 for preventing deformation of movable terminal strip 20 projects upward at each lateral end of movable terminal strip 20.

Threaded shank 32 fits through terminal screw insertion hole 14 of fixed terminal strip 10 and screws in terminal screw fastening hole 24 of movable terminal strip 20. Head 31, larger in diameter than threaded shank 32, is captivated in space 7.

In operation, narrow portion **10*b* is inserted through open portion 23*a* of movable terminal strip 20. Then move movable terminal strip 20 towards the front end of fixed terminal Strip 10 until catching portion 10*a* is caught in catching hole 23 of movable terminal Strip 20. Note that the dimensions of catching portion 10*a* is such that fixed terminal strip 10 cannot, in this configuration, slide out through open portion 23*a***.

Movable terminal strip 20 and fixed terminal strip 10 now freely swing about each other. Threaded shank 32 of terminal screw 30 is inserted through terminal screw insertion hole 14 of fixed terminal strip 10 and is screwed in terminal screw fastening hole 24 to form an assembly.

The assembly consisting of fixed terminal strip 10, movable terminal strip 20 and terminal screw 30 is installed into body frame 1. Front and rear stopper portions 11 and 13 at both sides of fixed terminal strip 10 are inserted into catching grooves 6 of body frame 1 from the open rear end of each groove 6 until stopper portions 11 and 13 are securely stopped. At this point, movable terminal strip 20 and threaded shank 32 of terminal screw 30 are positioned in terminal housing compartment 2 while head 31 of terminal screw 30 is captivated in space 7.

Fixed terminal strip 10 is supported by stopper hooks 12 of front stopper portions 11 and is thus prevented from accidentally slipping off catching grooves 6. In this state, head 31 of terminal screw 30 is located inside operation hole 5. Connecting portions 21 of movable terminal strip 20 are held in terminal housing compartment 2 generally aligned with wire insertion hole 3.

A screwdriver is inserted through operation hole 5 of body frame 1 to loosen terminal screw 30 so that movable terminal strip 20 swings counterclockwise around the engaging point where fixed terminal strip 10 engages catching hole 23. Downward force is generated by the engagement of head 31 with the interior of raised portion 4 adjacent operation aperture 5. Threaded shank 32 remains screwed into terminal screw fastening hole 24. The rotation of movable terminal strip 20 away from the interior surface of fixed terminal strip 10 is limited by contact with an interior surface of terminal housing compartment 2 to prevent terminal screw 30 from disengaging from terminal screw fastening hole 24.

Thus, connecting portion 21 and auxiliary connecting portion 25 move away from the underside of fixed terminal strip 10 into an opened position shown by double-dashed lines in FIG. 1. In this position, a wire, or other element may be inserted through wire insertion hole 3 to a position between movable terminal strip 20 and an inner surface of fixed terminal strip 10.

Terminal screw 30 is tightened to swing movable terminal strip 20 clockwise to move connecting portion 21 into secure contact with the element to be clamped against fixed terminal strip 10 as shown by solid line in FIG. 1. The clamped element, such as an electric wire, is snugly sandwiched between fixed terminal strip 10 and connecting portion 21 and auxiliary connecting portion 25 of movable terminal strip 20. The electric wire is thus securely connected to the terminal.

Turning terminal screw 30 in the reverse loosening direction disconnects the clamped electric wire by rotating movable terminal strip 20 toward the position shown by chain double dashed line in FIG. 1, thus separating connecting portion 21 and auxiliary connecting portion 25 away from fixed terminal strip 10. The loosening operation is performed positively by the downward force generated by contact between head 31 and the interior surface of raised portion 4 adjacent the perimeter of operation aperture 5. The electric wire is released from the clamping pressure of the sandwich connection to permit removal through wire insertion hole 3.

Although the previous explanation of the invention's operation referred to the above embodiment includes a plurality of terminal devices mounted on a terminal board, it would be apparent to one skilled in the art that the explanation applies equally well to a terminal board including only a single terminal device. In addition, an embodiment of the invention which omits the terminal board should also be considered to fall within the spirit and scope of the invention.

The present invention is applicable not only to a terminal board but also to a terminal device used for other electric appliances. Furthermore, the elements to be connected to a terminal device according to the invention are not limited to electric wire, ribbons or cable. It is apparent that other types of wire, ribbon or cable and terminator of a clamp-style terminal may also be connected.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A terminal device comprising:

a fixed terminal strip;

a terminal screw insertion hole in said fixed terminal strip;

a movable terminal strip;

means for hinging said movable terminal strip with respect to said fixed terminal strip;

a threaded hole in said movable terminal strip;

a terminal screw passing through said terminal screw insertion hole and threadingly engaging said threaded hole;

a raised portion overlapping said terminal screw;

means in said raised portion for permitting adjustment access therethrough to said terminal screw;

said means in said raised portion having a dimension effective for captivating said terminal screw, whereby said terminal screw, when loosened, is urged against an interior of said raised portion, and said terminal screw urges said movable terminal strip away from said fixed terminal strip;

means for permitting entering of an element to be clamped between said fixed terminal strip and said movable terminal strip when said movable terminal strip is in said loosened condition; and means on at least one of said fixed terminal strip and said movable terminal strip for clamping said element therebetween when said movable terminal strip is tightened.

2. A terminal device according to claim 1, further comprising:

means for limiting a range of said hinging to a value which maintains said threadable engagement between said terminal screw and said threaded hole at all possible conditions of said terminal screw, whereby a threadable engagement is maintained at all positions between fully tightened and fully loosened conditions of said terminal screw.

* * * * *